US005326000A

United States Patent [19]

Fuchs

[11] Patent Number: 5,326,000

[45] Date of Patent: Jul. 5, 1994

[54] MEDIUM DISPENSER WITH MOUNTING SUPPORT FOR OPTIONAL SECONDARY DISPENSING UNIT

[75] Inventor: Karl-Heinz Fuchs, Radolfzell, Fed. Rep. of Germany

[73] Assignee: Ing. Erich Pfeiffer GmbH & Co. KG, Fed. Rep. of Germany

[21] Appl. No.: 852,280

[22] Filed: Mar. 16, 1992

[30] Foreign Application Priority Data

Mar. 16, 1991 [DE] Fed. Rep. of Germany ..... 4108646

[51] Int. Cl.[5] ..... B05B 7/00

[52] U.S. Cl. ..... 222/321; 222/385; 239/333

[58] Field of Search ..... 222/321, 383, 385, 630, 222/631, 632, 207, 209; 239/333, 369, 414

[56] References Cited

U.S. PATENT DOCUMENTS

| | | | |
|---|---|---|---|
| 3,391,647 | 7/1968 | Corsette et al. | 222/374 X |
| 3,788,556 | 1/1974 | Riccio | 222/631 X |
| 3,933,279 | 1/1976 | Maier | 222/631 |
| 4,179,049 | 12/1979 | Umstead | 222/631 |
| 4,262,823 | 4/1981 | Monden | 222/321 |
| 4,305,530 | 12/1981 | Nozawa | 222/321 |
| 4,361,255 | 11/1982 | Saito et al. | 222/321 |
| 4,830,284 | 5/1989 | Maerte | 222/321 X |
| 5,100,029 | 3/1992 | Meshberg | 222/321 X |

FOREIGN PATENT DOCUMENTS

| | | | |
|---|---|---|---|
| 1475153 | 5/1969 | Fed. Rep. of Germany . | |
| 3620897 | 12/1987 | Fed. Rep. of Germany | 222/321 |
| 8711365 | 2/1989 | Fed. Rep. of Germany . | |
| 3834091 | 4/1990 | Fed. Rep. of Germany . | |
| 1401321 | 4/1964 | France | 239/333 |
| 2317969 | 2/1977 | France . | |
| 2397341 | 2/1979 | France . | |
| 0090996 | 5/1985 | Japan | 222/321 |
| WO8900085 | 1/1989 | PCT Int'l Appl. . | |

*Primary Examiner*—Andres Kashnikow
*Assistant Examiner*—Anthoula Pomrening
*Attorney, Agent, or Firm*—Quarles & Brady

[57] ABSTRACT

A discharge apparatus (1) is constructed as an air pump with two axially interconnected and constantly communicating pressure chamber parts (20, 21). Of these one surrounds a cap-like mounting support (10) for a further medium pump (2) and/or a reservoir (3) on the outer circumference. The mounting support (10) serves as a piston-like displacement body for the other pressure chamber part (21) and as a guide for the displaceable component (5) of the discharge apparatus (1). From the outside a fixing cap (31) can be inserted in a substantially clearance-free manner into the mounting support (10) and forms the connection between all the separate subassemblies, namely the discharge apparatus (1), the medium pump (2) and the reservoir (3). This gives a very simple construction and installation, accompanied by a high delivery volume.

12 Claims, 2 Drawing Sheets

MEDIUM DISPENSER WITH MOUNTING SUPPORT FOR OPTIONAL SECONDARY DISPENSING UNIT

BACKGROUND OF THE INVENTION

The invention relates to a discharge apparatus to be used for the discharge or delivery of at least one medium, which can be gaseous, liquid, pasty, pulverulent or the like. The discharge apparatus has a pressure source, e.g. a manually drivable pump, a pressure-filled aerosol container or the like, with a manually openable delivery or discharge valve or some similar pressure source. It appropriately at least partly or wholly forms a closed or preassembled subassembly or unit, which can be fixed to a support body. Such a support body can be a storage vessel or reservoir for at least one medium or a further discharge unit, such as a medium pump or one of the other aforementioned pressure sources. The latter permits the discharge of the medium simultaneously or independently of the first-mentioned pressure source.

For fixing purposes the subassembly, which appropriately encloses at least one substantially closed pressure or pump chamber, has a mounting support. The latter more particularly serves to supportingly secure the position of the discharge apparatus and can optionally also perform a functional movement for one discharge apparatus function.

A discharge apparatus known from French patent application 23 97 341 has an air or pneumatic pump. At the end of its pressure chamber is provided a cap-like mounting support for connection to the operating head of a liquid pump. This leads to a considerable overall length and for additional retaining purposes there is also an external guide casing.

However, according to French patent application 23 17 969 the air pump does not form a closed subassembly. Its pressure chamber must firstly be closed by a casing part of the liquid pump, i.e. only on assembly with the latter. In addition, during pump operation it has a size-increasing part.

It is very advantageous to use discharge apparatuses, in which the air pump piston is fixed to the liquid pump casing. However, then the air pump with its pump chamber does not form a closed constructional unit. Thus, there is a common structure or body, both for the air pump and for the medium pump.

OBJECTS OF THE INVENTION

An object of the invention is to avoid the disadvantages of known discharge apparatuses. Another object is to provide a discharge apparatus which, in the case of a very simple construction, ensures a simple assembly, a high delivery, low space requirements and/or a good adaptation to different, further discharge units. Further objects will be apparent from the description.

SUMMARY OF THE INVENTION

According to the invention the mounting support for the connection to the further discharge unit is at least partly located within the pressure chamber. For retaining engagement it can be constructed in a body or structure and/or in a component of the further discharge unit to be removed with respect thereto, e.g. for discharge. The mounting support is also substantially positionally rigid with respect to the adjacent area of the pressure change and/or a body adjacent thereto. Thus, it can form a one-part component with said body with respect to which a further component can be manually moved for discharge operation. If the discharge apparatus has several pressure chambers or if it serves to deliver from different reservoirs for media, then two or more mounting supports of the above-described type can be provided.

In the case of a discharge apparatus, which essentially defines a main axis and/or an operating direction, in the case of the described construction the mounting support is at least with part of its axial length in the same longitudinal area as the pressure chamber. This permits a significant shortening of the overall length of the discharge apparatus. Instead of having the mounting support projecting laterally inwards over the jacket inside of the pressure chamber or partly in the opposite direction out of the pressure chamber, it is appropriate in the in particular circular or annular pressure chamber extends substantially over the entire outer circumference of the mounting support. The latter can form a radially inner boundary of said pressure chamber or can project approximately coaxially freely into the pressure chamber. This can take place in such a way that e.g. for fitting the further discharge units or the like from the outside or one end of the pressure chamber it is still accessible when said chamber is closed ready to function.

In a preferred construction the mounting support in its length or assembly direction does not or only significantly project over the pressure chamber. Therefore it requires virtually no additional axial overall length. It can also serve as a piston-like displacement body for the pressure chamber. The latter need not be sealed with respect to a radially outer jacket boundary of a movable component of the discharge apparatus. It can also be guided in the vicinity of the inner circumference of said jacket boundary and therefore positionally secure said component against tilting movements.

The mounting support appropriately has a fitting or assembly opening for the insertion of the opposite member used for retaining the further discharge unit. In place of a threaded opening it is possible to have a plug-in or insertion opening, in which engages the opposite member at right angles to the insertion direction and in a substantially clearance-free manner, whilst being stop-limited in the insertion direction. The mounting support can also be constructed for the corresponding reception of an intermediate piece. The latter is constructed in such a way that with it the discharge apparatus and/or the further discharge unit can be fixed to a body, e.g. to the neck of the storage vessel or reservoir. In this case the intermediate piece is appropriately cap-shaped in the form of a screw cap, crimp ring or the like. On the outer circumference the mounting support engages round it in frictionally gripping manner with a certain jamming effect and with a ring shoulder tensions the further discharge unit in sealed manner against the face of the reservoir neck.

The insertion opening has a relatively large width if formed by the cap interior of a cap-like mounting support. The cap end wall can be traversed by a rod, which provides a functional connection to the further discharge unit, but is not used for its positional fixing with respect to the discharge apparatus. As a result of the described construction the further discharge unit, substantially in the manner described relative to the mounting support, engages in the pressure chamber. Thus, in its longitudinal area or that of the mounting support can engage a pressure or pump chamber, a pump piston located in the starting position, a discharge valve located within the casing or its piston, a casing or its cylinder cover and/or an inner restoring spring, or can be located entirely in said area. It is also possible for a support face of the further discharge unit for supporting on the reservoir neck or a fastening cap for fastening the further discharge unit to the said neck can be located partly or entirely within the pressure chamber or mounting support. Thus, the further discharge unit in this way engages with at least approximately half its casing length. The mounting support or pressure chamber also receives or engages over the reservoir neck.

Instead of only constricting the discharge apparatus pump pressure chamber by an elastic deformation of a pressure chamber wall, the pump is at least partly constructed as a thrust pump, particularly as a piston and/or bellows pump. As a result of its thrust movement advantageously substantially only the pressure chamber part located at right angles to the thrust movement and adjacent to the mounting support is bounded by a piston path or a pump bellows. A pressure chamber part connected axially to the inner end of the mounting support communicates in unsealed manner with the first mentioned part. However, said second part is slidingly sealed by the mounting support in the vicinity of a passage of a rod or the like.

The component movable for discharge operation with respect to the discharge apparatus body can be fitted from the body end remote from the mounting support fitting end. The said body is e.g. formed by a simple, double-walled torus, which can be closed in the vicinity of the pressure chamber at one end with an end wall surrounding in circular manner the mounting support and in the vicinity of the other end with the cap end wall of said mounting support. Thus, at one end there is a circular groove and at the other end the assembly or fitting opening. Both telescoped jacket walls have roughly the sane length extension. In the circular groove can then be inserted a sleeve-like piston jacket, which is appropriately constructed in one piece with an operating head of the discharge apparatus. The head forms an operating handle and/or carries a discharge opening leading into the open air. This head can be provided for operation or medium discharge both for the discharge apparatus and for the further discharge unit.

The discharge apparatus is particularly suitable for construction as an air pump in accordance with WO 89/00085, to which reference should be made for further details and effects. According to the invention the suction means for the pump can be located within the mounting support or its fitting opening. Thus, there is a substantially exclusively rising air circulation from outside the discharge apparatus up to an intake valve. Dirt particles can scarcely enter the intake valve or pressure chamber. The air circulation can be located between the inner circumference of the mounting support jacket and the inserted opposite member of the further discharge unit, e.g. in the form of at least one longitudinal groove.

The inventive discharge apparatus can also be fitted in such a way that initially substantially only the body having the mounting support is connected to the further discharge unit. Then the movable component is fitted by insertion and then optionally is connected by a plug-in connection with the red with an operating shaft of the further discharge unit projecting freely over the cap end wall. This is possible in a particularly simple manner if the two components of the discharge apparatus movable against one another are not directly supported on one another by means of a restoring spring and instead at least one restoring spring of the further discharge unit simultaneously serves as the restoring spring for the movable discharge apparatus component.

BRIEF FIGURE DESCRIPTION

These and further features can be gathered from the chins, description and drawings and the individual features, either singly or in the form of subcombinations, can be realized in an embodiment of the invention and in other fields and can represent advantageous, independently protectable constructions for which protection is hereby claimed. Embodiments of the invention are described in greater detail hereinafter relative to the drawings, wherein show:

FIG. 1 An inventive discharge apparatus, partly in axial section and assembled with a further discharge unit and a medium reservoir.

FIG. 2 Another embodiment of a discharge apparatus as a preassembled unit.

DETAILED DESCRIPTION OF PREFERRED EXAMPLE EMBODIMENTS

Figure 1:
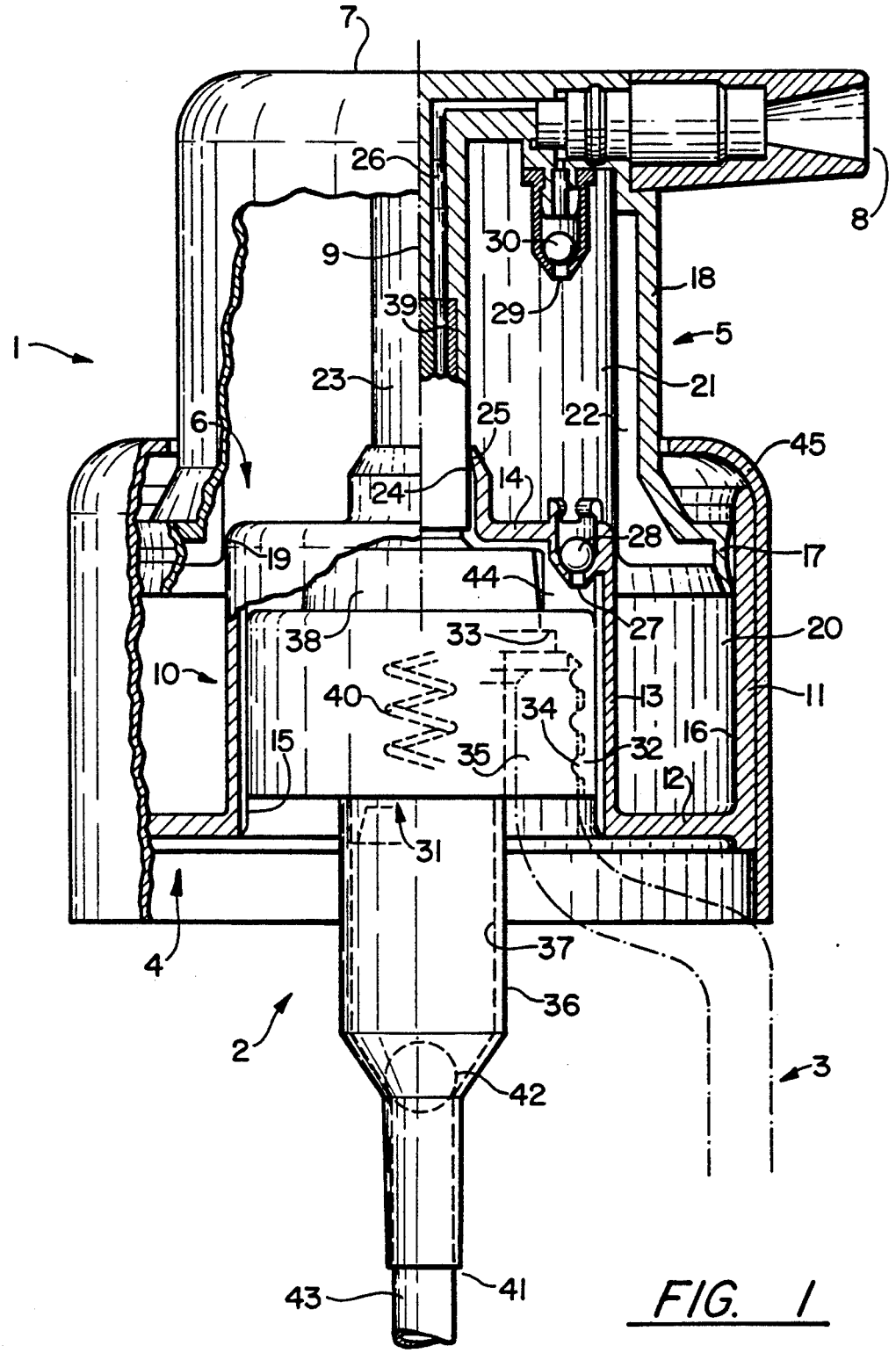

The discharge apparatus 1 is used for the carrying connection with a further discharge unit 2. If e.g. there is only to be a pressure charging of the reservoir with the discharge apparatus 1, the unit 2 can be directly formed by medium reservoir 3. To the latter is connected in carrying manner the basic body 4 of the discharge apparatus 1. This connection can be positionally rigid, or can be movable in the sense that a discharge operation is not impeded and by such a movement, such as a rotary movement, e.g. a counter is operated.

The thin-walled, substantially one-piece structure or body 4 forms a subassembly of the discharge apparatus 1. A further subassembly having a component 5 is movable and in particular linearly displaceable for discharge operation purposes. The basic body 4 can form a displacement body for generating a fluid pressure in the pressure chamber 6 through linear displacement relative to component 5. In this way a pressure chamber 6 enclosed between the body 4 and the component 5 is constricted. The pressure chamber 6 spacially extends over a chamber zone having a longitudinal chamber dimension and a transverse chamber dimension transverse to said longitudinal chamber dimension. The pressure chamber 6 defines margin sections which peripherally enclose the pressure chamber. The margin sections can include peripheral circumferences defined by jackets 11, 13 along the longitudinal chamber extension and opposing peripheral ends defined by jackets 7, 12 along the transverse chamber dimension. A handle 7 is provided for operation and is formed by an exposed end face of the component 5. The latter has a discharge opening 8, which can be formed e.g. by a nozzle insert inserted in the component 5. The discharge apparatus 1 defines a central axis 9. With respect to the said axis 9 the apparatus is substantially axially symmetrical, namely with the exception of the nozzle insert and the inlets/outlets. In said axis or roughly parallel thereto are provided the further discharge unit 2 or the medium reservoir 3, comprising a composite unit state with the discharge apparatus 1.

The invention includes means for alternately assembling the dispenser 1 with the at least one secondary unit, and the assembling the means includes at least one mounting support 10. The mounting support 10, appropriately located in the axis 9, is provided for fixing the discharge apparatus 1 and in the represented embodiment for the connection thereof to the discharge unit 2 and/or the medium reservoir 3. The mounting support is connected preferably in one piece with the body 4 and is surrounded in radially spaced manner on the outer circumference by a positionally rigid outer jacket, or which is connected in one piece thereto. In the immediate vicinity of one jacket end, said jacket 11 is connected by means of a circular end wall 12 at right angles to the axis 9 to an associated end of a sleeve jacket 13 of the mounting support 10. The end wall 12 does not project over the inner circumference of the sleeve jacket 13 or the outer circumference of the outer jacket 11. At the end remote from the end wall 12 the sleeve jacket 13 is substantially closed by a cap end wall 14 only slightly set back from the associated other end of the outer jacket 11 or positioned in the vicinity of said end. The wall 14 is constructed in one piece with the sleeve jacket 13 and does not project over its outer circumference.

As a result the cap interior of the mounting support 10 forms a relatively wide axially symmetrical assembly reception, such as opening 15, which has substantially constant internal cross-sections over its entire length. It is therefore open to full width at the outer end located in the plane of the end wall 12. This assembly opening 15 constitutes a non-positive or frictional connection between the discharge apparatus 1 and the discharge unit 2 or reservoir 3. The reception 15 is formed on an inner wall face separated by thickness of the wall section 13 from an outer wall face defining a margin section of the pressure chamber 6. Thus, these subassemblies can be interconnected in reciprocally turned positions or can be turned relative to one another in the connected state. The assembly or fitting opening 15 is directly bounded by the inner circumference of the elastically widenable sleeve jacket 13 and can be structured or roughened by longitudinal grooves or the like.

The outer jacket 11 is radially spaced from the sleeve jacket 13 and said spacing exceeds the wall thickness of the end wall 12 or the jacket 13. With its preferably approximately cylindrical inner circumference, the jacket 11 forms a piston path 16, which can extend from the end wall 12 to approximately the free end of the outer jacket 11. On said piston path 16 runs a circular or cap-like piston 17 with two axially succeeding and oppositely projecting sealing lips. The piston 17, appropriately including the sealing lips, is in one piece with a cap jacket 18 of the component 5 and therefore the handle 7 and consequently forms a hollow plunger.

The outer circumference of the cap jacket 18 is smaller than the piston 17 and forms the outermost jacket of the component 5. The cap jacket 18 projects freely from the piston 17 in the sane direction as the mounting support 10 from the end wall 12. The pump piston 17 or the cap jacket 18 and therefore the component 5 are slidably guided with respect to the approximately cylindrical outer circumference of the mounting support 10 with a guide 19. Thus, in each displacement or sliding position, said parts are supported and oriented in a centered manner. Thus, only limited tilting forces can act on the piston 17. Between the cup-shaped piston 17 passing via a circular disk-shaped end wall into the cap jacket 18, the end wall 12, the outer jacket 11 and the sleeve jacket 13 which defines an external circumference of the mounting support 10, is bounded a circular pressure chamber part 20, which is linked in open manner with a circular pressure chamber part 21 connected axially to the handle 7. In an initial position of the discharge operation, the mounting support 10 has an overall length extension which extends substantially over the overall length extension of the chamber part 20. The part 21 is bounded between the cap jacket 18, a central shaft 23, the mounting support 10 or the cap end wall 14 and the end wall of the component 5, which is constructed in one piece with the cap jacket 18 and forms with its outside the handle 7.

On the inner circumference of the cap jacket 18 there are uniformly circumferentially distributed, axial, rib-like guide webs 22 for forming the guide 19 and slide with their radially inner longitudinal edges on the outer circumference of the sleeve jacket 13. For the reinforcement of the piston 17, they extend up to the inside of its end wall or up to the inner circumference of its piston sleeve. Thus, connecting openings between the two pressure chamber parts 20, 21 are formed between the guide webs 22. The shaft 23 positioned with radial spacing within the cap jacket 18 projects freely inwards from the end wall of the component 5. The shaft is appropriately substantially located in the axis 9. In the starting position according to FIG. 1 the piston 17 is close to the free end of the outer jacket 11, in which it can be inserted from said end. The guide 19 is already active in this starting position, because the mounting support 10 projects into the piston 17.

In said starting position the shaft 23 also engages in the mounting support 10 or in its cap end wall 14, which is provided with a through opening 24. The latter is bounded by a sleeve projecting over the outer face of the cap end wall 14. At its free end the sleeve forms a ring lip-like sliding packing 25 sealingly engaging on the outer circumference of the shaft 23 and which projects into the pressure chamber part 21. For as long as the discharge unit is not fixed to the discharge apparatus 1, a fitting opening of the shaft 23 is accessible from its free end and through the interior of the mounting support 10 via the fitting opening 15. The shaft 23 forms a channel part of a medium discharge channel 26 connected to a corresponding discharge channel of the discharge unit 2. It is used for conveying medium to the discharge opening 8 from the medium reservoir 3 or the discharge unit 2.

The discharge apparatus 1 operates as an air pump, whose inlet 27 and outlet 29 face one another in the vicinity of the ends of the pressure chamber part 21. The inside width of the outer circumferential boundary of this part 21 is roughly of the sane size or only slightly larger than the outside width of the inner circumferential boundary of the part 20. However, the cross-sectional surfaces of beth pressure chamber parts 20, 21 can be roughly the same or that of the part 20 can be slightly larger than that of the part 21.

Adjacent to the inside of the cap end wall 14, the inlet 27 sucks from the interior of the mounting support 10 by means of an intake valve 28. The valve casing is constructed in one piece with the mounting support 10 and is appropriately connected roughly axially parallel to the axis 9 to the inner circumference of the sleeve jacket 13. The casing projects over the outer and/or inner face of the cap end wall 14. The outlet 29 located freely within the pressure chamber part 21 in spaced manner between the end wall of the cap jacket 18, the cap end wall 14, the cap jacket 18 and the shaft 23 passes from the discharge channel 26 to the discharge nozzle via a discharge or outlet valve 30. In said nozzle are brought together the two medium flows from the discharge apparatus 1 and the discharge unit 2, so that they are expelled together through the discharge opening 8. The casing of the discharge valve 30 is as a separate component fixed by a snap connection to a connecting piece, which belongs to the inside of the end wall of the cap jacket 18. Fixing takes place from the open side of the piston 17. The valve casing is also roughly axially parallel to the axis 9.

An intermediate piece 31 is fixed in the fitting opening 15 of the mounting support 10 with adequate friction and stop-limited in axial manner with respect to the cap end wall 14 and engages with an outer circumference of a jacket 32 into the boundary of the opening 15. The part 31 forms a separate or detachable component with respect to the discharge apparatus 1 and the discharge unit 2 or medium reservoir 3. The intermediate piece 31 is appropriately a ring cap, which forms at one end of the jacket 32 an inner ring shoulder 33 for fixing or tensioning the discharge unit 2 on the reservoir 3.

Consequently the intermediate piece 31 has separate fixing surfaces for the discharge apparatus 1, the discharge unit 2 and the reservoir 3. For the latter the fixing surface is forced by a thread 34 on the inner circumference of the jacket 32. The intermediate piece 31 is used for fixing to the neck 35 of the reservoir 3 and the jacket 32 engages over the outer circumference of the neck 35. With the end shoulder 33 is tensioned a ring flange of a body or casing 36 of the discharge unit 2 against the face of the neck 35, optionally accompanied by the interposing of a seal. The casing 36 then projects in contact-free manner into the reservoir 3 with respect to the inner circumference of the neck 35. The jacket 32 is firmly seated between the outer circumference of the reservoir neck 35 and the inner circumference of the jacket 13. If the body 4 is differently fixed to the discharge unit 2 or the reservoir, the parts engaging an the fitting opening 15 can be axial and/or radial and also contact-free relative to the mounting support, which then merely forms a receptacle.

The discharge unit 2 forms a fully functional discharge unit even without connection to the discharge apparatus 1 and in particular a thrust piston pump. In its casing 36 located roughly in the axis 9 is provided a pressure chamber 37 constrictable by a pump piston. The open end of the casing 36 located within the mounting support 10 is closed by a ring cap-like casing cover 38, which forms the ring flange for supporting the end shoulder 33 and, like the intermediate piece 31, is entirely located within the mounting support 10 and the cover does not project over its open end. Through the casing cover 38 projects to the outside of the casing 36 a hollow operating shaft 39 located roughly in the axis 9 and which is connected by an axial plug connection with the shaft 23 engaging over it and projecting in the starting position approximately up to the casing cover 38.

The operating shaft 39 is used for the discharge or pump operation of the discharge unit 2 and is therefore connected e.g. in one piece to the associated pump piston. In the interior the operating shaft 39 forms the associated portion of the discharge or outlet channel 26 connected to the pressure chamber 37, with the optional interposing of an outlet or discharge valve. The discharge valve body can be located with a shaft within the operating shaft 39 and therefore within the shaft 23. The passage opening in the casing cover 38 for the passage of the operating shaft 39 is sufficiently wide that, on operation, the shaft 23 can penetrate to the end position in the casing cover 38 or the casing 36.

For the restoring of the discharge unit 2, the casing 36 contains a restoring spring 40 located roughly in the axis 9 and which is appropriately located within the pressure chamber 37, the pump piston and/or the operating shaft. It can also be supported as a valve spring on the discharge valve body. This restoring spring 40 simultaneously returns the discharge apparatus 1 to the starting position. In the vicinity of the end projecting into the reservoir 3, the casing 36 has a medium inlet 41. The inlet is connected by means of an intake valve 42 to the pressure chamber 37. By means of an inserted riser 43 or the like medium from the lower area of the reservoir 3, during the return stroke, is sucked through the inlet into the pressure chamber 37.

If the axial length of the casing 36 without the riser 43 is measured, it is located with more than half its length within the mounting support 10. If the total length of the discharge unit 2, including the operating shaft 39, but without the riser 43 is measured, then more than half its length is located within the discharge apparatus 1.

The associated end of the casing 36 formed by the casing cover 38 and projecting over the outside of the end wall of the intermediate piece 31 is appropriately at a limited distance from the inner face of the cap end wall 14. For this purpose uniformly circumferentially distributed, rib-like projections 44 project over its inside and on these can engage on the one hand the casing 36 with the associated face of the casing cover 38 and on the other hand the intermediate piece 31 with its face. In the annular space between the outer circumference of the casing cover 38, the inner circumference of the sleeve jacket 13, the intermediate piece 31 and the cap end wall 14 is located the inlet 27, which can suck in air from the outside by means of the axial grooves along the outer circumference of the intermediate piece 31.

As the outer jacket 11 with the sleeve jacket 13 bounds a circular groove or side open to the associated end there is appropriately a cap-like or similar top casing 45, which closes the open side at least partly and engages closely on the outer circumference of the body 4 or the outer jacket 11. The part 45 also projects over the end of the body 4 associated with the end wall 12 and therefore forms a relatively uniform transition of the discharge apparatus 1 to the bulge of the reservoir 3.

On pressing down the handle 7 from the two pressure chambers 6, 37 the associated medium is delivered towards the discharge opening 8 and is discharged as a function of the setting of the discharge valves. During the return travel suction takes place into the pressure chamber 6 via the inlet 27, whilst suction takes place into the pressure chamber 37 via the inlet 41. In an end wall adjacent to the open end of the outer jacket 11, the top casing 45 has a through opening relatively closely adapted to the cap jacket 18 and through which projects outwards the piston sleeve 18 forming the shaft of the piston 17. Appropriately the piston 17 does not strike the end wall 12 in the pump stroke end position. This end position is in fact fixed by the striking of the pump piston of the discharge unit 2 at the end of the associated cylinder path also for the discharge apparatus 1. As the mounting support 10 is closely adapted to the inner circumference of the cap jacket 18 except for the narrow, approximately circular passage opening between the two pressure parts 20, 21, the mounting support 2 acts as a displacement body in part 21. However, it is not guided in sealing manner on the path on the cylinder formed by the cap jacket 18 in the sane way as the sealingly guided piston 17.

Figure 2:
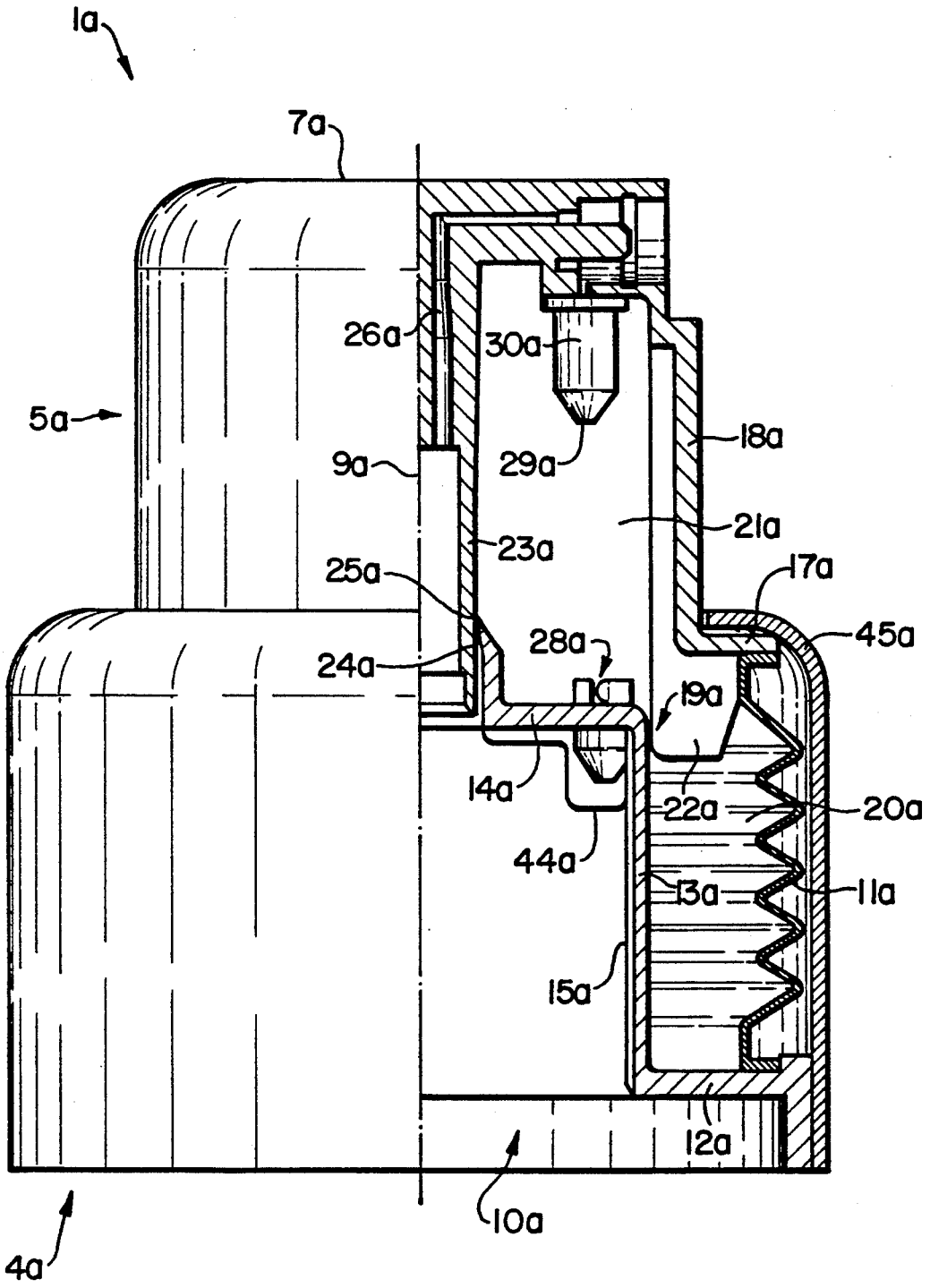

FIG. 2 uses for the same parts the sane reference numerals as in FIG. 1, but followed by the letter "a", so that the relevant description parts apply to both drawings. Random features of the described and represented embodiment can be additively or optionally provided on a single discharge apparatus.

FIG. 2 shows the discharge apparatus 1*a* alone, i.e. without the discharge unit, reservoir, intermediate piece and nozzle insert. In the starting position the movable component 5*a* can be stop-fixed on the inner shoulder of the circular end wall of the top casing 45*a*. Prior to fixing the nozzle insert the part 45*a* is mounted from the handle 7*a* and belongs to the body 4*a*. In the starting position the free end of the shaft 23*a* is completely within the passage opening 24*a* and is roughly in the plane of the bottom of the mounting support 10*a*.

In this embodiment the outer jacket of the pressure chamber part 20*a* is formed by a multiply, circularly folded bellows 11*a*, whose ring flange-like end is fixed to the inside of the end wall 12*a*, whilst its other ring flange-like end is fixed to the inside of a collar 17*a*. The latter projects outwards at the associated end of the cap jacket 18*a* and abuts against the top casing 45*a*. The bellows 11*a* can be resiliently elastically constructed in the manner of a restoring spring and its tension can be sufficient, at least in the state according to FIG. 2, to return the discharge apparatus 1*a* to its starting position and maintain it there.

The fixing of the outwardly directed end flanges of the bellows 11*a* to the body 4 or to the component 5*a* appropriately takes place by adhesion, e.g. welding or ultrasonic welding in such an intimate manner that there is a one-piece construction with the body 4*a* or component 5*a*, because the materials flow into one another in the vicinity of the connecting faces. The bellows 11*a*, located only with a gap spacing immediately adjacent to the inner circumference of the jacket of the top casing 5*a*, ensures a very good sealing of the pressure chamber, because no or only a single sliding seal or packing 25*a* is required for sealing the sane. As an essential pressure chamber part 20*a* is located on the outer circumference of the cap-like mounting support 10*a* and as the ring width of the other pressure chamber part 21*a* is much larger than said wall thicknesses of the body 4*a* or the component 5*a*, for a very short overall length a high delivery volume is obtained.

The guide webs 22*a* are extended beyond the inner face of the ring flange 17*a*, so that they can form a support for the inner circumference of the bellows 11*a*. With increasing folding the individual fold rings are guided with their inner circumferential edges on the support and are thereby secured in such a way that the bellows 11*a* cannot bend radially inwards. The inventive construction is particularly suitable for those discharge apparatuses with which a liquid medium develops under the supply of and mixing with air to form a foam and which is to be discharged as a stable foam. The mixing and/or foaming apparatus is advantageously located within the nozzle insert. Each of the described members, units and spaces can be provided in a single occurance or in a plurality of two or more, for example to provide multiple fluid discharge from multiple separate fluid or pressure sources to multiple external outlet openings.

I claim:

1. A dispenser for discharging media during a discharge operation, comprising:

at least one dispenser casing having at least one casing jacket (11, 13);

at least one pressure chamber peripherally bounded by said at least one casing jacket (11);

a plunger casing slidably mounted within said at least one dispenser casing said plunger casing and said casing jacket forming a substantially medium-tight seal at their junction, said at least one casing jacket (11) providing at least one inner sleeve (13) bounding an axial passage opening (24);

a central shaft axially mounted within said plunger casing and passing through said passage opening, said passage opening sealingly engaging said central shaft so as to prevent leakage from said at least one pressure chamber while permitting said central shaft to slide-within said passage opening to a depressed position;

a mounting support integrally formed at least partially within said at least one inner sleeve of said at least one casing jacket, said mounting support being constructed so as to engage a secondary discharge unit and maintain said at least one dispenser casing and said at least one casing jacket in a fixed position relative to said secondary discharge unit with respect to said discharge operation;

at least one discharge outlet and a chamber outlet for exhausting said at least one pressure chamber to said at least one discharge outlet via a discharge channel when the plunger casing is depressed into the at least one dispenser casing; and a second discharge channel traversing said central shaft and forming a passageway between said secondary discharge unit and said at least one discharge outlet; and whereby a compact dispenser is provided by:

forming said mounting support as part of said at least one pressure chamber;

circumferentially defining the at least one pressure chamber around the mounting support; and utilizing the plunger casing as part of the at least one pressure chamber.

2. The dispenser according to claim 1, wherein said at least one mounting support (10) is substantially completely located within said at least one pressure chamber (6).

3. The dispenser according to claim 1, wherein said at least one mounting support (10) has at least partly at least one of:

a sleeve-configuration; and a cap-configuration.

4. The dispenser according to claim 1, wherein sleeve jacket (13) extends from a transverse wall (12) to an end wall (14) of said at least one mounting support (10).

5. The dispenser according to claim 1, wherein said at least one mounting support (10) provides an assembling opening (15) for receiving said secondary discharge unit (2) by at least one of:

a plug insertion;

a stop-limited insertion; and a fixed positioning.

6. The dispenser according to claim 1, wherein said dispenser has at least two subassemblies (4, 5) moveable with respect to each other for performing said discharge operation, said at least one mounting support (10) being member of one of said subassemblies (4, 5).

7. The dispenser according to claim 6, wherein said subassemblies include one subassembly (4) positionally immoveable relative to at least one of:

a medium container (3) and a casing (36) of said secondary discharge unit (12) during the discharge operation.

8. The dispenser according to claim 1, wherein said at least one mounting support (10) is provided for mounting said at least one dispenser casing on at least one medium reservoir (3).

9. The dispenser according to claim 1, wherein at least one inlet valve (28) defining an inlet opening is provided for said at least one pressure chamber (6), said at least one mounting support defining an inner space ductively connected to said inlet opening, said inlet opening being located on said at least one mounting support (10).

10. The dispenser according to claim 1, wherein said at least one mounting support (10) and a chamber section (20) defined by said dispenser casing each defines an overall length dimension, in an initial position of said discharge operation, said overall length dimension of said at least one mounting support (10) extending substantially over said overall length dimension of said chamber section (20).

11. The dispenser according to claim 1, wherein said at least one dispenser casing and said plunger casing provide chamber sections (20, 21) for reciprocal fluid communication, a first one of said chamber sections (20) being located in the vicinity of said mounting support (10), said first one of said chamber sections having a width dimension wider than a corresponding width dimension of a second one of said chamber sections (21), said first and second chamber sections (20, 21) being substantially directly interconnected and substantially coaxial.

12. The dispenser according to claim 1, wherein said at least one casing jacket is formed within said at least one dispenser casing and is resiliently compressible, and thereby serving as a restoring means for returning said plunger casing away from said depressed position when it is released so as to replenish said at least one pressure chamber.

* * * * *